United States Patent [19]

Dueck

[11] Patent Number: 4,819,887

[45] Date of Patent: Apr. 11, 1989

[54] RACK FOR STORING AND DISPENSING ROLLED FLOOR COVERING

[76] Inventor: Willie B. Dueck, NE-33-23-2e Vidir, Arborg, Manitoba, Canada, ROC OAO

[21] Appl. No.: 130,956

[22] Filed: Dec. 10, 1987

[30] Foreign Application Priority Data

Jan. 14, 1987 [CA] Canada ..... 527294

[51] Int. Cl.[4] ..... B65H 19/00; A47F 07/18

[52] U.S. Cl. ..... 242/56 R; 242/55.3; 242/74.1; 211/44

[58] Field of Search ..... 242/56 R, 66, 58, 55.53, 242/74.1; 211/44, 121

[56] References Cited

U.S. PATENT DOCUMENTS

| | | | |
|---|---|---|---|
| 991,827 | 5/1911 | Capers . | |
| 1,211,242 | 1/1917 | Schaffer | 242/55.3 |
| 2,361,795 | 10/1944 | Roesen . | |
| 2,590,384 | 3/1952 | Dent et al. | 242/55.3 |
| 2,595,593 | 5/1952 | Manning . | |
| 2,833,487 | 5/1958 | Petty | 242/55.3 |
| 2,834,558 | 5/1958 | Halpin . | |
| 2,849,191 | 8/1958 | Gadler . | |
| 3,039,712 | 6/1962 | Weber et al. . | |
| 3,062,465 | 11/1962 | Hunter . | |
| 3,917,183 | 11/1975 | Malone | 242/56 R |
| 4,073,447 | 2/1978 | Wrenn | 242/56 R |

*Primary Examiner*—Stuart S. Levy
*Assistant Examiner*—Steven M. DuBois
*Attorney, Agent, or Firm*—Adrian D. Battison; Stanley G. Ade; Murray E. Thrift

[57] ABSTRACT

A rack for supporting a plurality of rolls of sheet material particularly floor covering is defined by a frame structure carrying two chains one at each end with the chains arranged to rotate around upper and lower chain wheels. The chains rotate in synchronism with support hooks carried on the chains and aligned transversely of the chains. A bar can be hooked onto the support hooks to receive a roll of the floor covering. The bar can be lifted into place by a lift mechanism in the form of an elongate bar with an upper and lower hook so the upper hook can engage over a previous bar and a lower hook can lift the intended bar to a position adjacent its receiving hook. An overcenter linkage then is used to reduce the length of the bar to lift the new bar into engagement with its respective hook. A wind up mechanism is attached to the frame at a forward station and comprises a pair of stub rollers one of which is rotated by a hand crank and expandable thereby to engage a tube and wind up material withdrawn from one of the rolls. A measuring device and transversely moveable knife blade are attached at the wind up station.

20 Claims, 6 Drawing Sheets

RACK FOR STORING AND DISPENSING ROLLED FLOOR COVERING

BACKGROUND OF THE INVENTION

This invention relates to a rack device for storing and dispensing rolled sheet material which is particularly but not exclusively used for floor covering either as carpet or vinyl flooring.

Stores selling such floor coverings must in many cases carry large quantities of the floor coverings and be in a position both to display the floor covering to a prospective purchaser and to dispense a measured length of the floor covering so that the purchaser can carry away his chosen purchase. In many cases this display and dispensing is carried out in a very haphazard manner with the rolls being mounted merely upon an elongate pin or rod and the floor covering pulled out over an expanse of the floor and then cut to a measured length. This is generally unsatisfactory in that it requires much labour and floor space in rolling and unrolling the material and in addition the floor covering material can become soiled.

Proposals have therefore been made to provide a rack device which comprises a pair of chains each of which rotates around upper and lower chain wheels with the upper chain wheels being arranged to be coaxial and the lower chain and the lower chain wheels to be arranged coaxial. The chains support aligned support hooks for grasping and carrying the elongate pins or bars on which a roll is mounted. Thus a plurality of rolls can be mounted upon the chains and carried around so that a desired one of the rolls is presented forwardly to a position at which it can be inspected and the material withdrawn.

However these devices have generally not been satisfactory and have not included any arrangements for handling the floor covering so that it is handled in the normal way of pulling out a length onto an adjacent floor space and then rewinding the material into a roll or package for transportation by the purchaser. In addition the lifting of the heavy rolls onto the frame or rack has been carried out either manually with much difficulty or by fork-lift truck or by other labour intensive and complex techniques.

SUMMARY

It is one object of the present invention, therefore, to provide a rack of this general type which is improved so that it can, according to one aspect, cause the material to be properly rolled at a display station forwardly of the rack to avoid the material having to be pulled from the roll over an adjacent floor space.

Secondly it is an object of the present invention to provide an improved lifting device which is of simple construction by which the rolls can be lifted onto the rack.

According to a first aspect of the invention, therefore, there is provided a rack device for storing and dispensing rolled sheet material comprising a frame structure having ground engaging means such that the frame structure can stand on the ground defining an upper portion and a lower portion, two elongate flexible members each arranged adjacent a respective end of the frame structure, a first and second pair of wheels each pair arranged to engage and support a respective one of said flexible members such that it forms an endless loop with the pairs defining two upper wheels rotatable about a common upper axis and two lower wheels rotatable about a common lower axis, means for driving said flexible members such that they rotate synchronously about said upper and lower axes, each of said members carrying a plurality of support means thereon for rotation therewith, with the support means of one aligned with the support means of the other, said aligned support means being arranged to releasibly support an elongate member extending thereacross for receiving thereon a roll of said sheet material such that the rolls can be supported on the members in parallel spaced relation for rotation therewith and presentation of each in turn at a station forwardly of the frame structure, means mounted at said station for winding up a length of said sheet material drawn from that roll presented at that time at said station, and knife means having a guide for guiding the knife means in movement transversely to the length of the sheet material to sever said wound length and means at one end of the frame for actuating movement of said knife thereacross.

The station therefore preferably includes the transversely movable knife and also a wind up arrangement mounted on the frame structure.

This can preferably be provided by a beam which extends from one end of the frame structurally to the other end and which defines a tube for receiving an elongate chain which carries the knife across the width of the frame for cutting the material. In addition the beam preferably supports a pair of stub rollers at respective ends of the frame structure so that a tube can be slipped onto the stub rollers simply by axially movement in one direction to engage over one of the rollers and then in the return direction to engage the second roller. One of the rollers is preferably expandable to grasp the inner surface of the tube to rotate the tube in driving manner. The driving force can preferably be provided by a hand crank arranged adjacent a hand crank which operates the knife and adjacent a metering roller which can be pressed into engagement with the floor covering to measure its length as it is rolled onto the stub rollers.

According to a second aspect of the invention there is provided a rack device for storing and dispensing rolled sheet material comprising a frame structure having ground engaging means such that the frame structure can stand on the ground defining an upper portion and a lower portion, two elongate flexible members each arranged adjacent a respective end of the frame structure, a first and second pair of wheels each pair arranged to engage and support a respective one of said flexible members such that it forms an endless loop with the pairs defining two upper wheels rotatable about a common upper axis and two lower wheels rotatable about a common lower axis, means for driving said flexible members such that they rotate synchronously about said upper and lower axes, each of said members carrying a plurality of support means thereon for rotation therewith, with the support means of one aligned with the support means of the other, said aligned support means being arranged to releasibly support an elongate member extending thereacross for receiving thereon a roll of said sheet material such that the rolls can be supported on the members in parallel spaced relation for rotation therewith and presentation of each in turn at a station forwardly of the frame structure, means for loading a respective elongate member and attached roll onto a respective one of said support means, said loading means comprising a member having means for engaging said elongate member and means for engaging one of said support means and associated elongate members spaced from said respective support means such that rotation of said flexible members causes said respective elongate member and attached roll to be lifted to move into engagement with said respective support means.

This provides the advantage therefore that the motive force for lifting the rolls, which can of course be very heavy, from the ground onto a support member is provided by the rotation of the flexible members or chains so that the bar looped over an upper support member lifts the roll onto a lower support member. The bar preferably includes a pivotal lever which is pivotally coupled to parts of the bar at spaced positions along the length of the lever so that movement of the lever increases or decreases the length of the bar to lift the roll over a hook to be received in the cup of the hook. The lifting bar can be then removed. This arrangement is therefore a very simple construction and requires little manual effort and uses the motive force already available on the rack.

According to a third aspect of the invention there is provided a rack device for storing and dispensing rolled sheet material comprising a frame structure having ground engaging means such that the frame structure can stand on the ground defining an upper portion and a lower portion, two elongate flexible members each arranged adjacent a respective end of the frame structure, a first and second pair of wheels each pair arranged to engage and support a respective one of said flexible members such that it forms an endless loop with the pairs defining two upper wheels rotatable about a common upper axis and two lower wheels rotatable about a common lower axis, means for driving said flexible members such that they rotate synchronously about said upper and lower axes, each of said members carrying a plurality of support means thereon for rotation therewith, with the support means of one aligned with the support means of the other, said aligned support means being arranged to releasibly support an elongate member extending thereacross for receiving thereon a roll of said sheet material such that the rolls can be supported on the members in parallel spaced relation for rotation therewith and presentation of each in turn at a station forwardly of the frame structure, means mounted at said station for winding up a length of said sheet material drawn from that roll presented at that time at said station, and a cylindrical body for receiving said length of said material to be wound thereon, said cylindrical body having on an outer-peripheral surface thereof an elongate latch member mounted for pivotal movement about an axis longitudinal of the peripheral surface, said latch members having a latch portion extending outwardly to one side of said axis and movable between a grasping position in which it engages and grasps an edge of said material lying against said peripheral surface and a release position in which the latch portion is spaced from the peripheral surface to release the edge of the material, and a lift portion extending outwardly from said axis to a side opposed to said latch portion and arranged such that when said latch portion is in said grasping position said lift portion is raised relative to said peripheral surface and arranged so as to support the length of material away from the peripheral surface as it is rolled, and when said latch portion is in said raised position said lift portion lies flat against the peripheral surface so that the length of material is no longer supported away from the peripheral surface and the cylindrical body can be pulled longitudinally out of the rolled material, and means for locking said latch portion in said grasping position.

This enables the material to be readily wound onto a roll or core which is then removed for re-use while the material remains wound into the roll.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
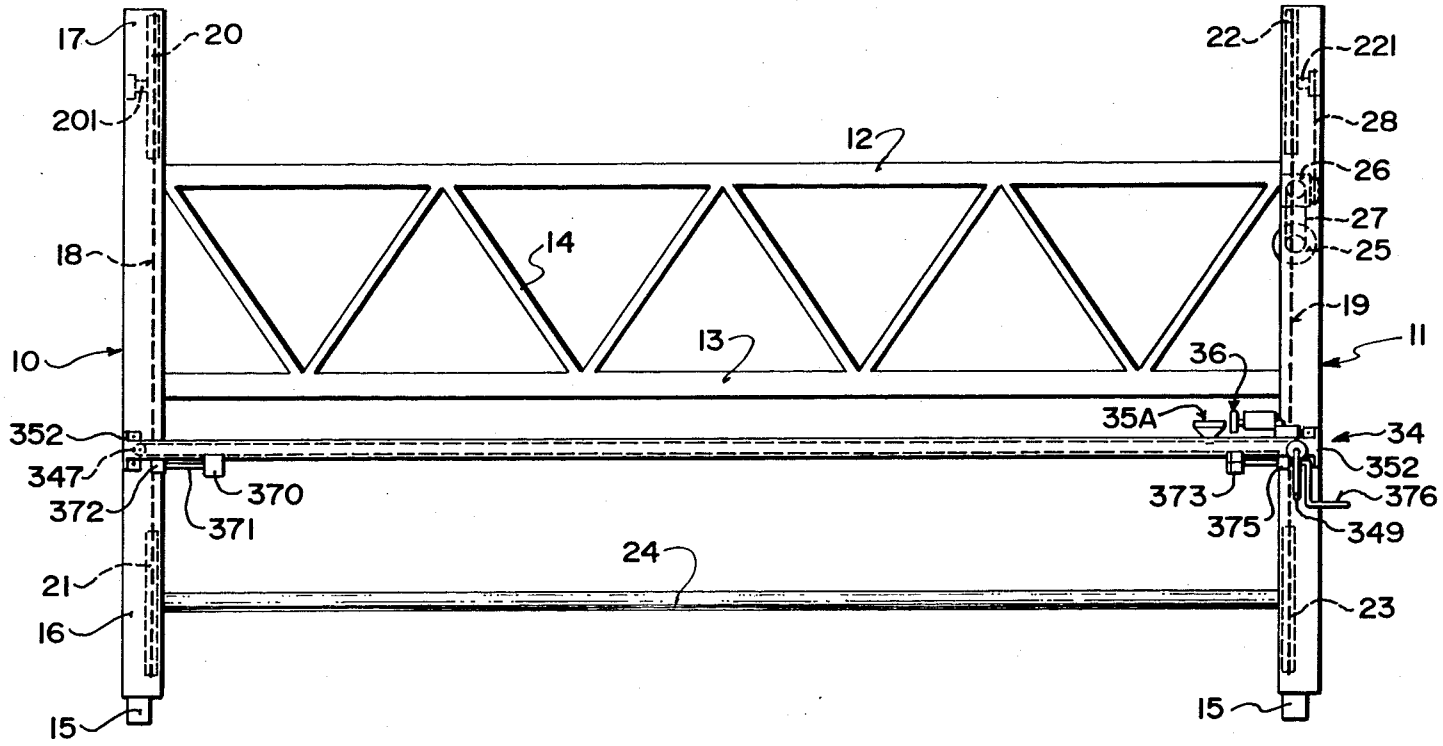
FIG. 1 is a front elevational view of a rack according to the invention with the rolls of floor covering removed for convenience of illustration.
Figure 2:
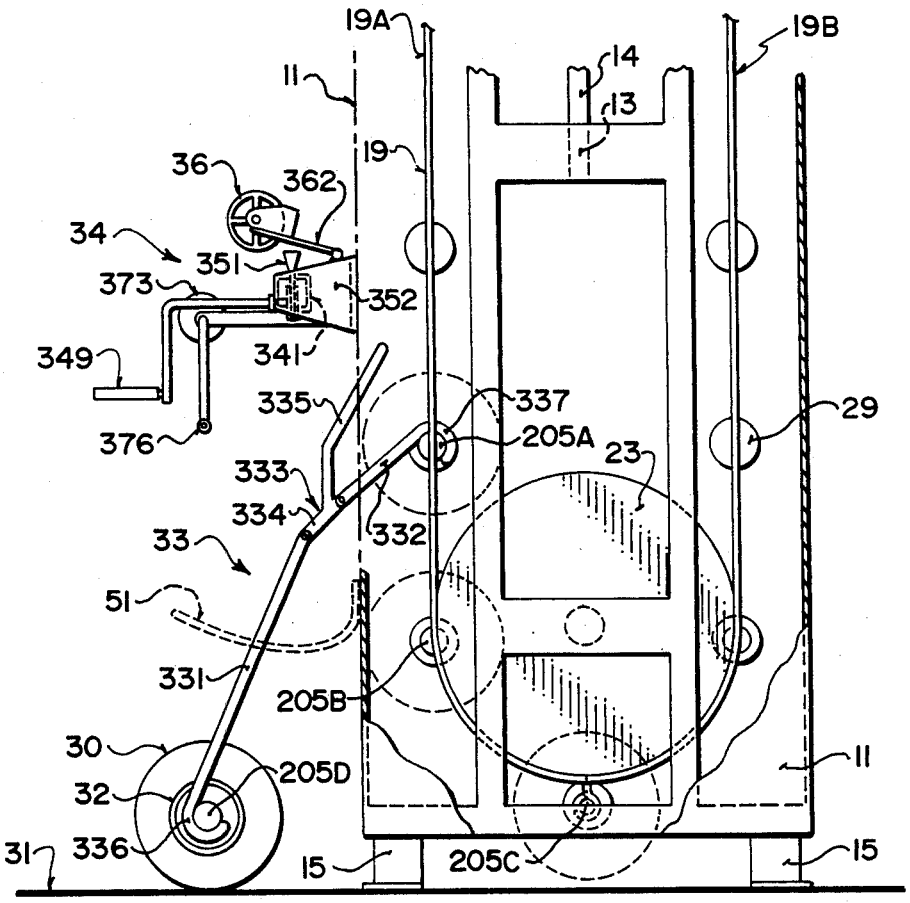
FIG. 2 is an end elevational view of the rack of FIG. 1.
Figure 3:
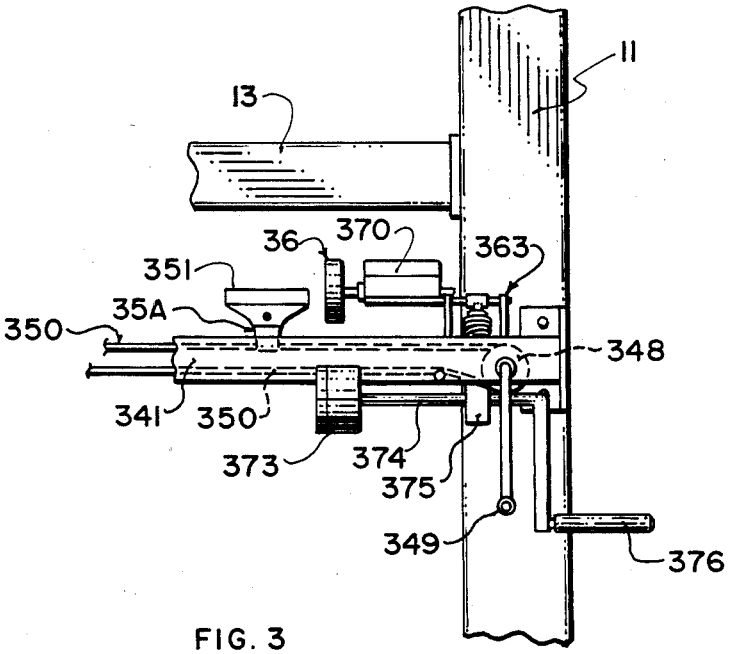
FIG. 3 is a front elevational view similar to FIG. 1 on an enlarged scale of a portion only of the rack.

The rack shown generally in FIGS. 1 and 2 comprises a pair of end plate members 10 and 11 which are formed of suitable frame members and covering end plates to provide rigidity to the structure, as will be within the skill of a competent engineer. The end plate members 10 and 11 are interconnected by transverse beams 12 and 13 which again are constructed to provide stiffness against twisting both about vertical and horizontal axes of the frame structure. The transverse beams 12 and 13 are interconnected by stiffening struts 14 to form a complete rigid framework.

A lower end of the end plates 10 and 11 carries ground engaging legs 15 so that the frame structure can rest upon the ground and can extend therefrom upwardly to define a lower end 16 and an upper end 17 the latter of which may be at a height of the order of 8 to 12 feet depending upon the available ceiling height and other criteria of an engineering nature.

Each end plate member 10 and 11 encloses a flexible chain loop 18 and 19 shown only schematically in FIGS. 1 and 2 and carried by chain wheels 20, 21 and 22, 23. The chains thus wrap around the chain wheels to define a closed loop which has a forward run 191 and a rearward run 192 as shown in FIG. 2.

The upper chain wheels 20 and 22 are mounted upon stub shafts 201, 221 for rotation about an upper horizontal axis which is common to the chain wheels and extends across the upper portion of the frame structure. The lower chain wheels 21 and 23 are mounted upon a common shaft 24 which extends across the lower portion of the frame structure. The chain wheel 22 is driven by a motor 25 via a gear box 26 and chains 27 and 28 so that the chains 18 and 19 rotate in synchronism around the axes defined by the upper and lower chain wheels.

Each chain carries a plurality of support members which are aligned transversely between the chains for carrying rolls of the floor covering material. In FIG. 2 the support members are shown only schematically and indicated generally at 29.

Figure 5:
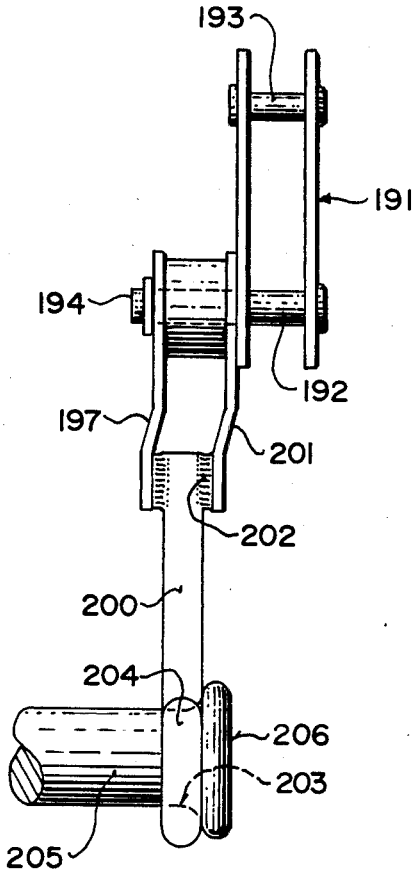
FIG. 5 is a front elevational view of a portion of one of the chains of the rack of FIG. 1.
Figure 6:
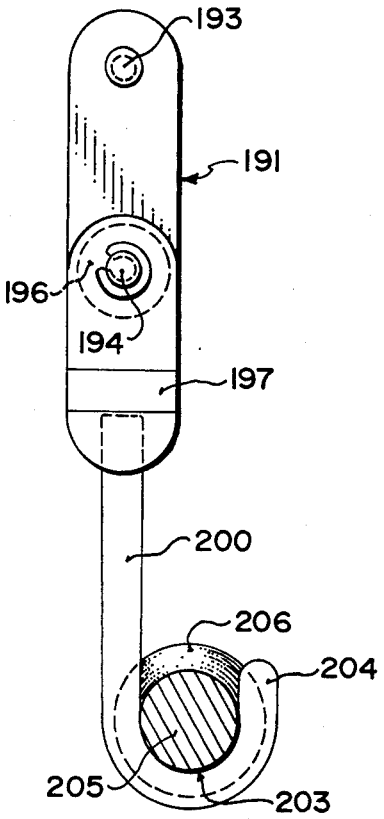
FIG. 6 is a side elevational view of the portion of FIG. 5.

In FIGS. 5 and 6 one of the support members is shown in more detail. Specifically one link of the chain 19 is indicated at 191 and comprises a pair of pivot pins 192 and 193 on which the next links pivot in conventional manner. The next links are for convenience of illustration not shown but it will be appreciated that the chain 19 is of a conventional nature.

The pivot pin 192 is an extended pivot pin so as to define an outwardly extending portion 194 which projects to the inwardly facing side of the chain 19. Upon the portion 194 is mounted a pivot coupling 195 in the form of a bearing 196 with downwardly depending plates 197 and 198 to which is welded as indicated at 202 a hook member 200. The plates 197 and 198 are cranked outwardly at 201 so as to space the hook member inwardly from the remainder of the links of the chain. It will be appreciated that the pivot coupling 195 is free to pivot about the extension portion 194 so that gravity will tend to pull the hook downwardly so as to lie beneath the extension portion 194 regardless of the orientation of the associated link 191 which will of course vary as the chain extends around the chain wheels and passes along the forward and rearward runs.

The hook 200 includes a cup portion 203 and an upwardly projecting finger 204 which can receive and cradle an end 205 of an elongate rod 206. The head or end 205 acts to locate the rod so that it is prevented from sliding axially and dropping off the hook. The rod extends along the full length of the frame structure and carries a similar head at the opposed end for cooperation with a similar hook on the chain 18.

Reverting now to FIG. 2, first one of the rods is indicated attached to the chain 19 at 205A. The attachment linkage is shown only schematically for convenience of illustration but it will be appreciated that it takes the form of the hook arrangement 200 of FIGS. 5 and 6. A second such bar 205B is positioned at the next adjacent point on the chain 19 and sufficiently spaced from the first so that a roll can be carried at each point without the outside dimensions of the rolls of material interfering when carried by the chain. A third position is indicated at 205C and is at this stage free from the intended roll of the material. The intended roll is indicated generally at 30 and is positioned on a floor or support level indicated at 31. The roll of the material includes a tubular core 32 through which passes the bar 205D which is of the same construction as the bar 205 illustrated in FIG. 5.

A lifting device in the form of an elongate bar for attaching the roll 30 to its intended location 205C is shown generally at 33. The device comprises a first lever portion 331 and a second lever portion 332 each of which is pivotally coupled to a central manually actuable lever 333. The lever 333 includes a crank portion 334 and a manually graspable handle 335. The pivotal connection between the lever portions 331 and 332 and the central crank 334 are spaced so that the orientation of the central crank 334 determines the spacing between the outer ends of the lever portions 331 and 332.

The outer end of each of the lever portions 331 and 332 carries a loop 336 and 337 for engaging over the bars 205A and 205D respectively.

In use of the lifting device 33, the rotation of the chains 18 and 19 is halted with the bar 205A at the required position so that the upper loop 337 can just extend over that bar while the lower loop engages over the bar 205D. With the handle 335 released, the lever portions 331 and 332 and the central crank 334 take up a straight line with a maximum distance between the loops 336 and 337. The chains 18 and 19 are then moved so that the forward run moves upwardly by actuation of the motor 25. This draws the roll 30 inwardly and upwardly so that it lies along side the station 205C to which it is to be attached. At that point the handle 335 is pulled downwardly so as to reduce the spacing between the loops 336 and 337 thus lifting the bar 205D over the front finger 204 of the respective hook 200. The handle 335 is then released lowering the bar 205D into the cup 203. The length of the lift mechanism 33 is arranged relative to the spacing between the positions 205A and 205C so that the lift mechanism can be removed when the bar 205D is supported in its respective hooks. It will of course be appreciated that two such lifting mechanisms 33 are provided one for each end of the bars 205 and for the respective chains 18 and 19.

With the rolls of material thus loaded onto the chains 18 and 19, the rolls can be rotated by actuation of the motor 25 so that each in turn is presented forwardly at an inspection and unwind station generally indicated at 34. A potential customer can then inspect each of the rolls in turn or may choose one of the rolls on the rack for particular inspection by rotating all of the rolls past the inspection station until the required roll reaches the station.

The inspection and unwind station 34 comprises a transverse beam 341 which extends along the full length of the frame and is coupled to each of the end plate members 10 and 11. The beam 341 is formed by two channels 342 and 343 which are welded together inwardly facing at a weld line 345 thus leaving a slot 346 in an upper face thereof. Within each end of the beam 341 is mounted a chain wheel 347, 348 the latter of which is attached to a hand crank 349 which can be rotated manually to rotate the chain wheel 348. The chain wheels carry a chain 350 which extends along the full length of the beam 341 with an upper and a lower run. The upper run carries a knife mechanism 351 which projects upwardly through the slot 346 and also carries a guard which is mounted at a slightly forwardly inclined angle and acts to prevent engagement of the knife with objects such as fingers which cannot slide beneath the guard. It will be appreciated therefore that manual operation of the hand crank 349 will cause the blade or knife mechanism 351 to run along the length of the beam 341 to cause slitting of floor covering material drawn forwardly from the roll over the beam 341. It will also be noted in this regard that the beam 341 is supported forwardly of the forward face of the end plate member 11 by brackets 352.

Figure 4:
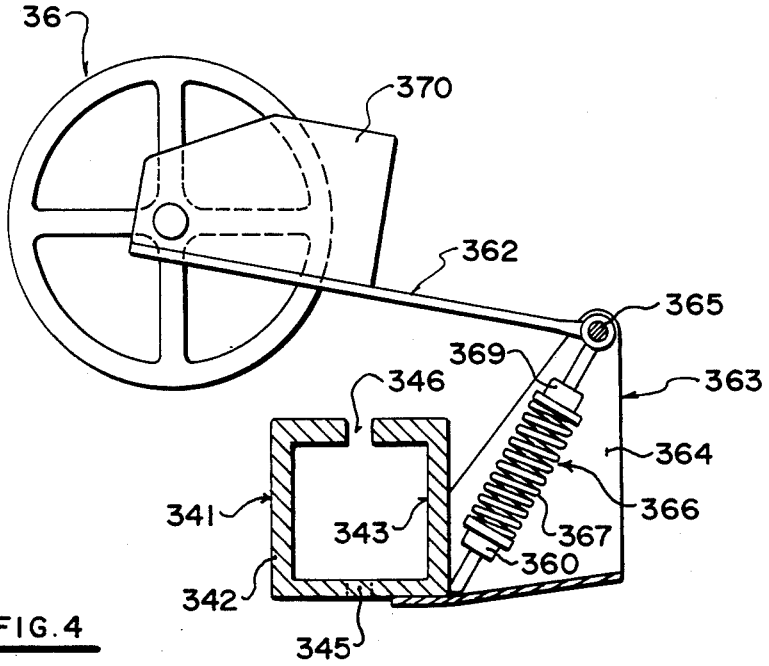
FIG. 4 is an enlarged view partly in cross section of the knife mechanism and metering roll of the rack of FIGS. 1 and 2.

A metering roll 36 is mounted at the end adjacent the hand crank 349 so that it can be dropped into engagement with the floor covering material as it is drawn from the roll. Thus the metering roll 36 is mounted upon a bracket 361 carried on a strap 362 which is cantilevered outwardly to one side of a support mechanism 363. The support mechanism is best shown in FIG. 4 and comprises a pair of upright brackets 364 and a transverse rod 365 supported on the upright bracket 364. The rod 365 is attached to a bistable spring mechanism 366 which includes a central spring 367 and a pair of end engaging members 368, 369 so that the spring tends to be bistable so that it can flip the roller 36 upwardly from contact with the material through a central position shown in FIG. 4 to a lower position in which the roller is pressed into contact with the material. The rôller includes a counter 370 on which the length of material withdrawn from the roller is displayed so that the proper length as ordered can be measured.

Figure 7:
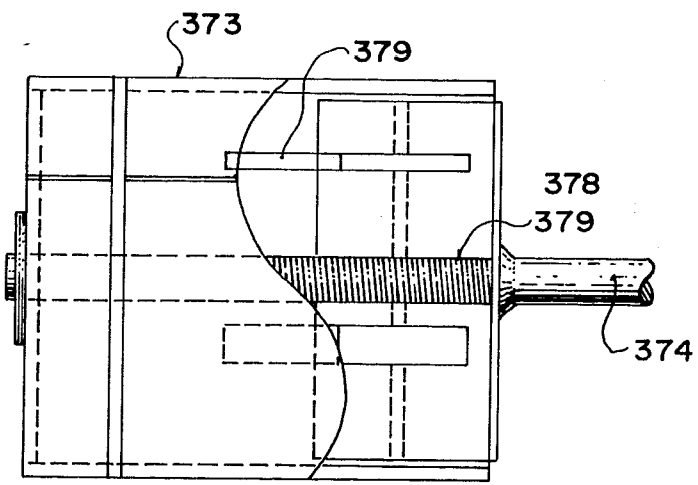
FIG. 7 is an enlarged view of one end roller of the wind up mechanism of the rack of FIG. 3.

A length of the material is drawn from the roll on the chains is withdrawn and wound up simultaneously by a wind up mechanism. The wind up mechanism is defined by a pair of stub rollers 370 and 371 each of which is mounted at a respective end of the frame. The stub roller 370 simply comprises a short length of roller mounted upon bearings carried on a shaft 371 attached by a bracket 372 to the end plate member 10. The diameter of the rollers is such that it is a loose fit inside a support tube for the material. Thus the stub roller is presented on the shaft 371 for rotation about a horizontal axis common to the axis of the stub roller 371. The stub roller 371 is shown in more detail in FIGS. 7 and 8. That roller is mounted upon a shaft 374 carried in bearings 375 on the end plate member 11. The shaft 374 also carries a hand crank 376 by which the shaft can be rotated by manual actuation of the hand crank.

Figure 8:
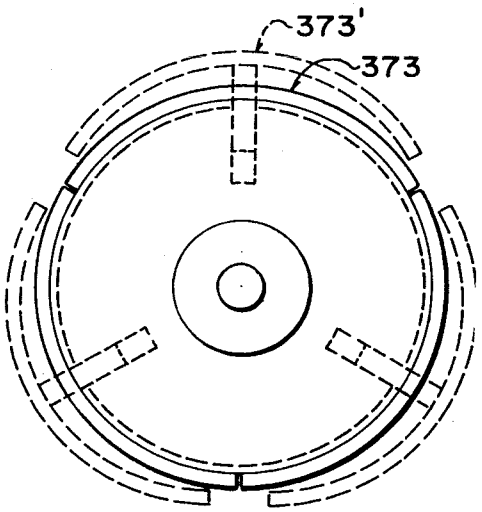
FIG. 8 is an end elevational view of the roller of FIG. 7.

The roller body 373 is formed in three separate portions as shown in FIG. 8 which can be expanded radially by a ramp 377 actuated by a plate 378 which includes an internal screw thread for cooperation with a screw thread 379 on the shaft 374. Thus rotation of the hand crank initially acts to move the plate 378 axially along the roller body so as to expand the roller body into contact with a tube positioned thereon. The tube is not shown in FIG. 1 but it will be appreciated that the tube can be moved into position initially by sliding the tube from a position adjacent the stub rollers onto one of the stub rollers until it can be aligned with the axis of the stub rollers following which it can be moved axially in the opposed direction to engage onto the other of the stub rollers. The expansion of the stub roller 373 to engage the inner surface of the tube thus acts to hold the tube in position to prevent its axial movement while further rotation of the hand crank 376 causes rotation of the tube to wind up the sheet material fed thereto.

In operation, therefore, the chosen sheet material is withdrawn manually to a position engaging the tube on the stub rollers and is attached thereto by for example adhesive tape. The measuring roller is then dropped into engagement with the material and the hand crank 376 actuated to roll the material onto the tube until the counter 370 has reached the required length of material measured. The knife 351 is then actuated by rotation of the hand crank 349 which is conveniently located adjacent the hand crank 376 to move the blade from one end of the frame to the other to sever the material. The wound material and supporting tube can then be removed from the stub-rollers for sale or delivery.

In an alternative arrangement (not shown) for use with carpet rolls, the simple elongate rod or pin which can support the interior of a roll of vinyl floor covering is replace by a cradle which supports the exterior of the heavier carpet. The cradle includes a frame having two pins at opposed ends for engaging the links as previously described. The cradle includes for example three sets of rollers at spaced positions therealong. Each set has two upper rollers at the front and rear of the cradle and two lower guide rollers so that a belt can pass over the rollers in a loop defining an inner run supporting an exterior of the carpet roll.

Figure 9:
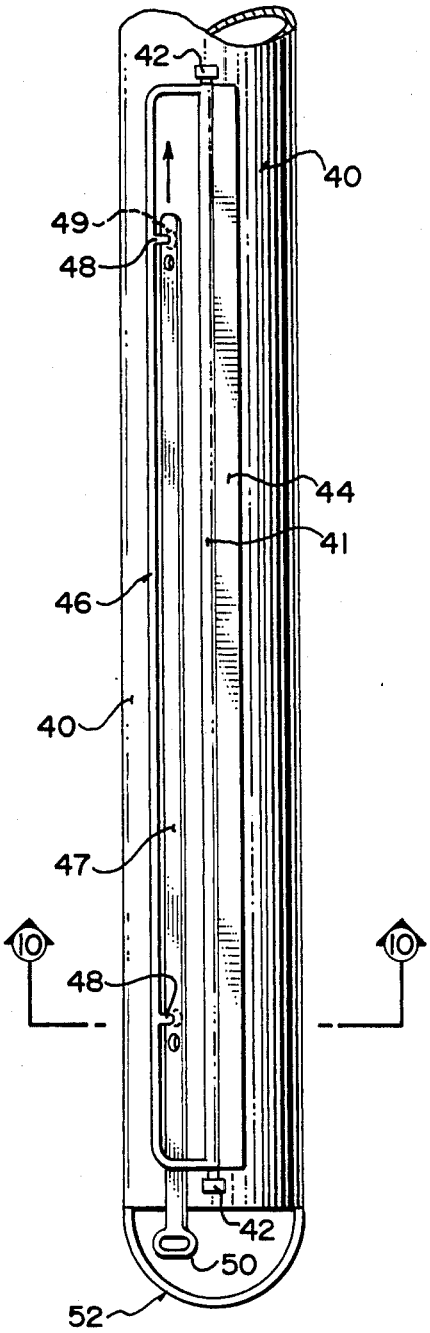
FIG. 9 is a side elevational view of one part of a support tube for rolling up the withdrawn material.
Figure 10:
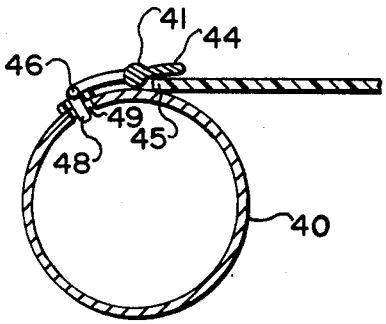
FIG. 10 is a cross-sectional view along the lines 10—10 of FIG. 9 showing the latching device for the material edge in release condition.
Figure 11:
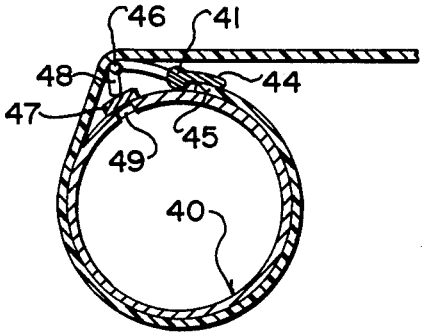
FIG. 11 is a view similar to that of FIG. 10 showing the latching device in grasping condition.

Turning now to FIGS. 9, 10 and 11, a roll-up core is shown which can be mounted upon the stub rollers of the wind-up station as a removable and re-usable core which will generally be used in place of the available card board cores when the length of material taken is insufficient to warrant the use of a card board core.

The roll-up core comprises a tubular sleeve 40 defining a cylindrical body having a peripheral surface upon which the flooring material is to be rolled. The sleeve has open ends so it can be slipped onto the stub shafts as previously described.

On the outer face of the sleeve is mounted a pivot shaft 41 carried in suitable bushings 42 for pivotal movement about an axis longitudinal of the sleeve and at the peripheral surface of the sleeve. On one side of the pivot shaft is mounted a plate 44 which is arranged for grasping an edge 45 of the sheet material at the winding station. The plate 44 extends along the sleeve and is of narrow width merely sufficient to grasp the edge 45 and hold it in position as the sleeve commences in rotation so as to pull the material onto the roll in a winding action.

On an opposed side of the shaft 41 relative to the plate 44 is provided a support wire 46 which extends outwardly from the shaft and then along the shaft at a spacing from the shaft greater than the width of the plate 44.

The angle and positioning of the support wire and the clamping plate are shown in FIGS. 10 and 11 and it will be noted that they are movable about the pivot shaft 41 into two different positions as shown in FIGS. 10 and 11 respectively. Specifically in FIG. 10 the wire 46 lies flat against the peripheral surface of the sleeve and the plate 44 is thus raised away from the peripheral surface into a release position. In FIG. 11 the wire 46 is raised by a manual grasping of the wire to lift it away from the peripheral surface which acts to pivot the plate 44 into a clamping position to grasp the end 45 of the material. In FIG. 11, the sleeve 40 has been rotated through one revolution to wind up one turn of the material onto the sleeve. It will be noted thus that the material is obliged to pass over the support wire 46 so as to increase the diameter of the material wrapped around the roll.

The latching mechanism provided by the support wire and the plate 44 are freely pivotable on the shaft 41 but can be locked into the position shown in FIG. 11 that is the grasping position by the cooperation of a slide member 47 and a leg 48 depending downwardly from the wire 46. In the position shown in FIG. 10, the leg 48 projects into an opening 49 in the surface of the sleeve. In the position shown in FIG. 11, the leg is prevented from entering the opening 49 by the slide member 47 which can be moved longitudinally of the sleeve by a manually graspable handle 50 so as to move it from a latching position to a release position.

In operation of the device, the sleeve as shown in FIG. 11 is rotated until the measured length of the material is wrapped in spiral turns on the sleeve 40. The handle 50 is then actuated to release the latching member from its position shown in FIG. 11 so that it can collapse into the position shown in FIG. 10 which is as will be apparent of reduced diameter relative to the inside turn of the material wrapped on the sleeve. The sleeve and latching mechanism are therefore free to be pulled from the interior of the formed roll. In practice, before the sleeve is removed from the roll, the sleeve and the roll are dropped from the stub rollers onto a cradle 51 formed by a pair of brackets extending outwardly from the front of the frame at a position beneath the winding station. The roll is thus supported upon the brackets 51 and the sleeve can be pulled manually from the end of the roll by grasping a loop type handle 52 arranged on one end of the sleeve. In FIG. 9 is shown only one-half of the wind-up core and the second latching member can be provided on the core in the other half operable from the opposed end of the core.

In an alternative arrangement of the drive mechanism shown in FIG. 1, the drive to the main drive wheels 20 and 22 is provided by a shaft extending along the full length of the frame with the shaft carrying at each end a length of chain welded around the shaft so as to cooperate with the sprocket teeth of the main drive wheel 20 and 22 respectively. The shaft is then driven directly by a motor.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A rack device for storing and dispensing rolled sheet material comprising a frame structure having ground engaging means such that the frame structure can stand on the ground defining an upper portion and a lower portion, two elongate flexible members each arranged adjacent a respective end of the frame structure, a first and second pair of wheels each pair arranged to engage and support a respective one of said flexible members such that it forms an endless loop with the pairs defining two upper wheels rotatable about a common upper axis and two lower wheels rotatable about a common lower axis, means for driving said flexible members such that they rotate synchronously about said upper and lower axes, each of said members carrying a plurality of support means thereon for rotation therewith, with the support means of one aligned with the support means of the other, said aligned support means being arranged to releasibly support an elongate member extending thereacross for receiving thereon a roll of said sheet material such that the rolls can be supported on the members in parallel spaced relation for rotation therewith and presentation of each in turn at a station forwardly of the frame structure, means mounted at said station for winding up a length of said sheet material drawn from that roll presented at that time at said station, and knife means having a guide for guiding the knife means in movement transversely to the length of the sheet material to sever said wound length means at one end of the frame for actuating movement of said knife thereacross, and means for lifting a respective elongate member and attached roll onto a respective one of said support means, said lifting means comprising a member having means for engaging said elongate member and means for engaging one of said support means and associated elongate members spaced from said respective support means such that rotation of said flexible members causes said respective elongate member and attached roll to be lifted to move into engagement with said respective support means.

2. The invention according to claim 1 wherein said knife means is mounted upon a flexible transport member which extends across the full width of the frame structure and can be moved transversely across the frame structure around guide rollers at opposed ends thereof.

3. The invention according to claim 2 wherein the flexible transport member is mounted within a tube which includes a slot for the knife to extend from the flexible member within the tube to a position outwardly of the tube for cutting the sheet material extending over the tube.

4. The invention according to claim 2 including drive means for driving one of said guide members and wherein said flexible transport member comprises an endless loop member wrapped around said guide members to define a knife transport run and a return run thereof.

5. The invention according to claim 1 including a metering device mounted at said station.

6. The invention according to claim 1 including a frame member extending longitudinally of said frame structure and interconnecting said opposed ends thereof, said frame member including means supporting said means for winding up said length and said knife means.

7. The invention according to claim 6 wherein said frame member is tubular and includes an elongate flexible member therein for carrying a knife transversely of said frame structure to sever said wound length.

8. The invention according to claim 6 including hand crank means for driving said wind up means and hand crank means for driving said knife means, both said hand crank means being arranged at one end of said frame structure and adjacent a metering device.

9. The invention according to claim 1 wherein said flexible members each comprise a chain formed from links interconnected by pivot pins and wherein said support means comprises a pivotal support hook attached to a pivot pin of said chain which has an extension portion extending to one side of the chain whereby said hook is freely pivotal relative to said chain and said pivot pin.

10. The invention according to claim 9 wherein said elongate member comprises an elongate rod which extends from one chain to the other chain, said rod being supported at respective ends on said hook members.

11. The invention according to claim 1 wherein said lifting means comprises a bar having a first loop at one end for engaging over said one of said elongate members and a loop at an opposed end for engaging said respective elongate member.

12. The invention according to claim 11 including manually operable means for temporarily reducing and then increasing the length of said bar so as to further raise said respective elongate member.

13. The invention according to claim 11 wherein said bar is formed in two portions, said portions being interconnected by a lever which is pivotally coupled to each of the portions at positions spaced along the length of the lever such that movement of the lever varies the distance between the ends of the bar.

14. A rack device for storing and dispensing rolled sheet material comprising a frame structure having ground engaging means such that the frame structure can stand on the ground defining an upper portion and a lower portion, two elongate flexible members each arranged adjacent a respective end of the frame structure, a first and second pair of wheels each pair arranged to engage and support a respective one of said flexible members such that it forms an endless loop with the pairs defining two upper wheels rotatable about a common upper axis and two lower wheels rotatable about a common lower axis, means for driving said flexible members such that they rotate synchronously about said upper and lower axes, each of said members carrying a plurality of support means thereon for rotation therewith, with the support means of one aligned with the support means of the other, said aligned support means being arranged to releasibly support an elongate member extending thereacross for receiving thereon a roll of said sheet material such that the rolls can be supported on the members in parallel spaced relation for rotation therewith and presentation of each in turn at a station forwardly of the frame structure, means for lifting a respective elongate member and attached roll onto a respective one of said support means, said lifting means comprising a member having means for engaging said elongate member and means for engaging one of said support means and associated elongate members spaced from said respective support means such that rotation of said flexible members causes said respective elongate member and attached roll to be lifted to move into engagement with said respective support means.

15. The invention according to claim 14 wherein said lifting means comprises a bar having a first loop at one end for engaging over said one of said elongate members and a loop at an opposed end for engaging said respective elongate member.

16. The invention according to claim 14 including manually operable means for temporarily reducing and then increasing the length of said bar so as to further raise said respective elongate member.

17. The invention according to claim 15 wherein said bar is formed in two portions, said portions being interconnected by a lever which is pivotally coupled to each of the portions at positions spaced along the length of the lever such that movement of the lever varies the distance between the ends of the bar.

18. A rack device for storing and dispensing rolled sheet material comprising a frame structure having ground engaging means such that the frame structure can stand on the ground defining an upper portion and a lower portion, two elongate flexible members each arranged adjacent a respective end of the frame structure, a first and second pair of wheels each pair arranged to engage and support a respective one of said flexible members such that it forms an endless loop with the pairs defining two upper wheels rotatable about a common upper axis and two lower wheels rotatable about a common lower axis, means for driving said flexible members such that they rotate synchronously about said upper and lower axes, each of said members carrying a plurality of support means thereon for rotation therewith, with the support means of one aligned with the support means of the other, said aligned support means being arranged to releasibly support an elongate member extending thereacross for receiving thereon a roll of said sheet material such that the rolls can be supported on the members in parallel spaced relation for rotation therewith and presentation of each in turn at a station forwardly of the frame structure, means mounted at said station for winding up a length of said sheet material drawn from that roll presented at that time at said station, and a cylindrical body for receiving said length of said material to be wound thereon, said cylindrical body having on an outer-peripheral surface thereof an elongate latch member mounted for pivotal movement about an axis longitudinal of the peripheral surface, said latch member having a latch portion extending outwardly to one side of said axis and movable between a grasping position in which it engages and grasps an edge of said material lying against said peripheral surface and a release position in which the latch portion is spaced from the peripheral surface to release the edge of the material, and a lift portion extending outwardly from said axis to a side opposed to said latch portion and arranged such that when said latch portion is in said grasping position said lift portion is raised relative to said peripheral surface and arranged so as to support the length of material away from the peripheral surface as it is rolled, and when said latch portion is in said raised position said lift portion lies flat against the peripheral surface so that the length of material is no longer supported away from the peripheral surface and the cylindrical body can be pulled longitudinally out of the rolled material, and means for locking said latch portion in said grasping position.

19. The invention according to claim 18 wherein said latch portion comprises an elongate plate member arranged to pinch said edge between the plate member and said peripheral surface, wherein said lift portion comprises an elongate wire extending longitudinally of the peripheral surface and connected to said plate member at positions spaced along the length of the wire.

20. The invention according to claim 19 wherein said frame includes a cradle arranged beneath said station for receiving said roll of material and said cylindrical body when released from the station such that the cylindrical body can be pulled longitudinally from the roll while the roll is supported in the cradle.

* * * * *